US009647375B2

(12) United States Patent
Lee et al.

(10) Patent No.: US 9,647,375 B2
(45) Date of Patent: May 9, 2017

(54) POWER CONNECTOR PRODUCTS WITH IMPROVED SAFETY SHUTTERS

(71) Applicant: Europlugs LLC, Chandler, AZ (US)

(72) Inventors: Rock Lee, Chandler, AZ (US); Harrison Lee, Chandler, AZ (US); Ying Huang, Fujian Province (CN)

(73) Assignee: EUROPLUGS LLC, Chandler, AZ (US)

( * ) Notice: Subject to any disclaimer, the term of this patent is extended or adjusted under 35 U.S.C. 154(b) by 0 days.

(21) Appl. No.: 15/089,600

(22) Filed: Apr. 4, 2016

(65) Prior Publication Data

US 2016/0301154 A1 Oct. 13, 2016

Related U.S. Application Data

(63) Continuation-in-part of application No. 14/683,248, filed on Apr. 10, 2015, now Pat. No. 9,484,659.

(51) Int. Cl.

| | |
|---|---|
| ***H01R 13/44*** | (2006.01) |
| ***H01R 13/453*** | (2006.01) |
| *H01R 103/00* | (2006.01) |
| *H01R 24/78* | (2011.01) |

(52) U.S. Cl.

CPC ..... *H01R 13/4534* (2013.01); *H01R 24/78* (2013.01); *H01R 2103/00* (2013.01)

(58) Field of Classification Search

CPC .... H01R 31/02; H01R 31/652; H01R 13/447; H01R 13/4534; H01R 13/4536; H01R 13/4532; H01R 13/6275; H02G 3/18; H02G 3/14

USPC ..... 439/105, 106, 135–145, 149, 345; 174/53, 66–67

See application file for complete search history.

(56) References Cited

U.S. PATENT DOCUMENTS

| | | | | |
|---|---|---|---|---|
| 5,702,259 A * | 12/1997 | Lee | H01R 13/4534 | 439/137 |
| 5,919,060 A * | 7/1999 | Lee | H01R 31/06 | 439/177 |
| 7,527,508 B1 * | 5/2009 | Lee | H01R 13/4534 | 439/137 |
| 7,753,700 B2 * | 7/2010 | Ma | H01R 13/4534 | 439/133 |

(Continued)

FOREIGN PATENT DOCUMENTS

| | | |
|---|---|---|
| GB | 793000 | 4/1958 |
| GB | 2199996 B | 7/1988 |

*Primary Examiner* — Thanh Tam Le

(74) *Attorney, Agent, or Firm* — Jackson IPG PLLC; Demian K. Jackson

(57) ABSTRACT

The present invention relates to a power connector for receiving an electric plug. The power connector is provided with a three-piece safety shutter architecture to prevent unwanted or improper insertion of a single plug pole into the power receptacles. In this architecture, the locking bar is formed with a first and a second tabs. The first and second tabs work with a protrusion formed therebetween to engage with the safety shutters and keep the safety shutters spaced apart from each other by a predetermined distance, so that the safety shutters are slidably latched in parallel by the locking bar and only allowed to travel dependently of each other along the travel direction, making the invention to meet the strict international safety standards for household plugs, adapters and socket-outlets.

11 Claims, 20 Drawing Sheets

(56) References Cited

U.S. PATENT DOCUMENTS

| | | | | |
|---|---|---|---|---|
| 7,820,909 | B2 * | 10/2010 | Castaldo | H01R 13/4534 174/53 |
| 7,833,030 | B1 * | 11/2010 | Huang | H01R 13/4534 439/137 |
| 7,942,681 | B2 * | 5/2011 | Ni | H01R 13/4534 439/137 |
| 8,044,299 | B2 * | 10/2011 | Weeks | H01R 13/4534 174/53 |
| 8,193,445 | B2 * | 6/2012 | Li | H01R 13/4534 174/50 |
| 8,366,463 | B2 * | 2/2013 | Zhang | H01R 13/4534 439/135 |
| 8,753,149 | B2 * | 6/2014 | Lee | H01R 13/4534 439/653 |

* cited by examiner

POWER CONNECTOR PRODUCTS WITH IMPROVED SAFETY SHUTTERS

CROSS-REFERENCE TO RELATED APPLICATION

This application is a continuation-in-part of U.S. application Ser. No. 14/683,248 filed Apr. 10, 2015, the entirety of which is incorporated herein by reference.

BACKGROUND OF THE INVENTION

Field of the Invention

The present invention relates to a power connector for receiving an electric plug, and more particularly to a power connector provided with an improved safety shutter, allowing the invention to meet the strict international safety standards for household plugs, adapters and socket-outlets.

Description of Related Art

Many European countries, including Portugal, Finland, Denmark, Norway and Sweden, require installment of safety shutters in socket outlets to prevent children from poking objects into them. To meet the requirement that the socket shutters can be opened up only when the live and neutral poles of a plug are inserted at the same time, some single-piece shutter designs have been proposed in the art, such as those disclosed in Great Britain Patent Publication Nos. 793000 and 2199996. However, such designs were frequently found hard to operate, as considerable force was needed to drive the relatively large shutter plate to its open position. It has also been found that the safety shutters of some conventional sockets will fail to work and the receiving surfaces of the safety shutters can wear out quickly, when receiving an electric plug with relatively sharp edges, such as a typical US polarized plug 9 having an edge inclined at 50° relative to its flat tip as shown in FIG. 6. The shortcomings are likely due to the small contact area between the plug tips and the safety shutters, as well as the relatively weak component force produced in the direction perpendicular to the insertion direction.

Additional problems may arise due to the limited space which the shutter plate must share with other elements in the socket cavity. For example, referring to the traditional universal socket arrangement illustrated in FIG. 14, an upright grounding system 50"" is disposed at the center of the socket cavity and, thus, the shutter plate 30"" is spatially hindered from moving towards the grounding system 50"". To address this issue, the shutter plate 30"" was arranged to open up the outlets by moving away from the grounding system 50"". As a consequence, the traditional device is unsatisfactorily large in size and the portability thereof is undesirably compromised. Moreover, when a socket of this type receives a Schuko CEE 7/4 plug having flat grounding contacts, the safety shutters 30"", biased by the spiral springs 33"", apply a force to the live and neutral poles of the Schuko plug and, therefore, tend to push the plug away from the grounding metal of the socket to create a gap between the plug and the socket, causing a poor grounding connection. An unofficial test conducted by the inventors showed that the conventional safety shutters could disadvantageously lead to unreliable grounding connection at a defect rate as high as 40%.

The co-pending U.S. application Ser. No. 14/683,248, assigned to the present applicant, discloses a power connector provided with a three-piece safety shutter architecture. In this architecture, a pair of safety shutters are interlocked with each other by slidably engaging the guide members of the safety shutters with the tabs extending from a traversely movable locking bar, where one of the guide members is in the form of a guide groove and the other is in the form of a side wall of the safety shutters. While the three-piece safety shutter architecture was proved to overcome the disadvantages above to a great extent, there remains a need for an improved power connector device that can fulfill the national safety requirements, especially when receiving a Schuko plug that is normally designed to be insertable in either way.

SUMMARY OF THE INVENTION

In one aspect provided herein is a new and improved power connector for engagement with an electric plug, which is equipped with safety shutters for preventing unwanted or improper insertion of a single male contact of the plug into the power receptacles thereof. The power connector comprises:

- a dielectric housing, comprising a top face panel, wherein the top face panel is formed with two power receptacles through which the male power contacts may be inserted;
- two power output frames mounted spaced apart in the housing, each having an output contact portion facing towards the top face panel and adapted for receiving the respective male contact of the electric plug through the respective power receptacle along an insertion direction, and an input portion remote from the top face panel;
- a pair of safety shutters mounted in parallel within the housing, wherein the safety shutters are biased in a travel direction generally perpendicular to the insertion direction by respective biasing members to an advancing position to close the power receptacles and each formed with a guide groove; and
- an elongated locking bar mounted in the housing in a manner extending and movable along a traverse direction traversing the travel direction and unmovable in the travel direction, wherein the locking bar is provided with a first tab and a second tab which are separate from each other by a given distance and slidably engage the respective guide grooves, so that the two guide grooves are spaced apart in parallel by said given distance;
- whereby the safety shutters travel dependently of each other along the travel direction to a retracted position to open the power receptacles in response to insertion of the male power contacts.

By virtue of the three-piece safety shutter architecture described above, the problems caused by the conventional one-piece shutter plate are solved. In short, the safety shutters are slidably latched in parallel by the locking bar and only allowed to travel dependently of each other along the travel direction, so that the locking bar can stop a single power pin to open the live receptacle, but will slide along the traverse direction to open the safety shutters when the safety shutters are pushed by two power pins at the same time. In comparison to the counterpart device shown in FIG. 13 which meets the U.S. national Standards and is not equipped with safety shutters, the power connector disclosed herein can prevent unwanted or improper insertion of a single plug pole into the power receptacles. It is also important to note that the universal socket arrangement disclosed herein is so compact that it can reduce the overall size of the power connector by half as compared to the traditional device shown in FIG. 14.

In a preferred aspect provided herein, the locking bar is further formed with a protrusion between the first tab and the second tab, and the protrusion is formed with two end faces facing towards and adapted to slidably abut against the respective side walls of the safety shutters. As such, the first tab, the second tab and the protrusion work together to keep the safety shutters spaced apart from each other by a predetermined distance, thereby making the safety shutters travel dependently of each other.

In another preferred aspect provided herein, the safety shutters each includes a slant surface arranged proximate to the top face panel and adapted for receiving a pressing force from the male power contact. More preferably, the slant surfaces are configured to incline at an angle of about 30 degree relative to the travel direction, thereby overcoming the problems regarding the failure of safety shutters.

In another preferred aspect provided herein, the power connector is further provided with a common grounding frame, which comprises a resilient metal clip facing towards the top face panel. The resilient metal clip has two free ends extending upwardly and outwardly beyond the top face panel to constitute a Schuko contact in the form of two metal plates anchored on the top face panel. More preferably, the Schuko contact is bent over to provide additional strength for countering the downward force generated by insertion of a three-pin plug.

In yet another preferred aspect provided herein, the safety shutters are so arranged that they are driven to move towards the Schuko contact in response to insertion of the electric plug. It was unexpectedly found by the inventors that such arrangement facilitates the attachment of the flat ground contact of a Schuko CEE 7/4 plug onto the Schuko contact of the power connector disclosed herein by urging the safety shutters to push the plug towards the Schuko contact. As a result, the potential gap between the plug and the power connector is almost non-existent, and the problem of unreliable grounding connection occurring in the traditional devices is reduced to the minimum.

In still another preferred aspect provided herein, the power output frames each comprises an input portion facing towards the bottom face panel, and the common grounding frame comprises a common grounding base facing towards the bottom face panel. The input portions and the common grounding base are each directly riveted with a conductive coupler for electrical connection to an external power source.

The power connector disclosed herein is intended to serve as a common architecture applicable to various forms of adapters and socket-outlets.

DETAILED DESCRIPTION OF THE PREFERRED EMBODIMENTS

The technical contents and characteristics of the present invention will be apparent with reference to the detailed description of preferred embodiments accompanied with related drawings as follows.

Figure 1A:
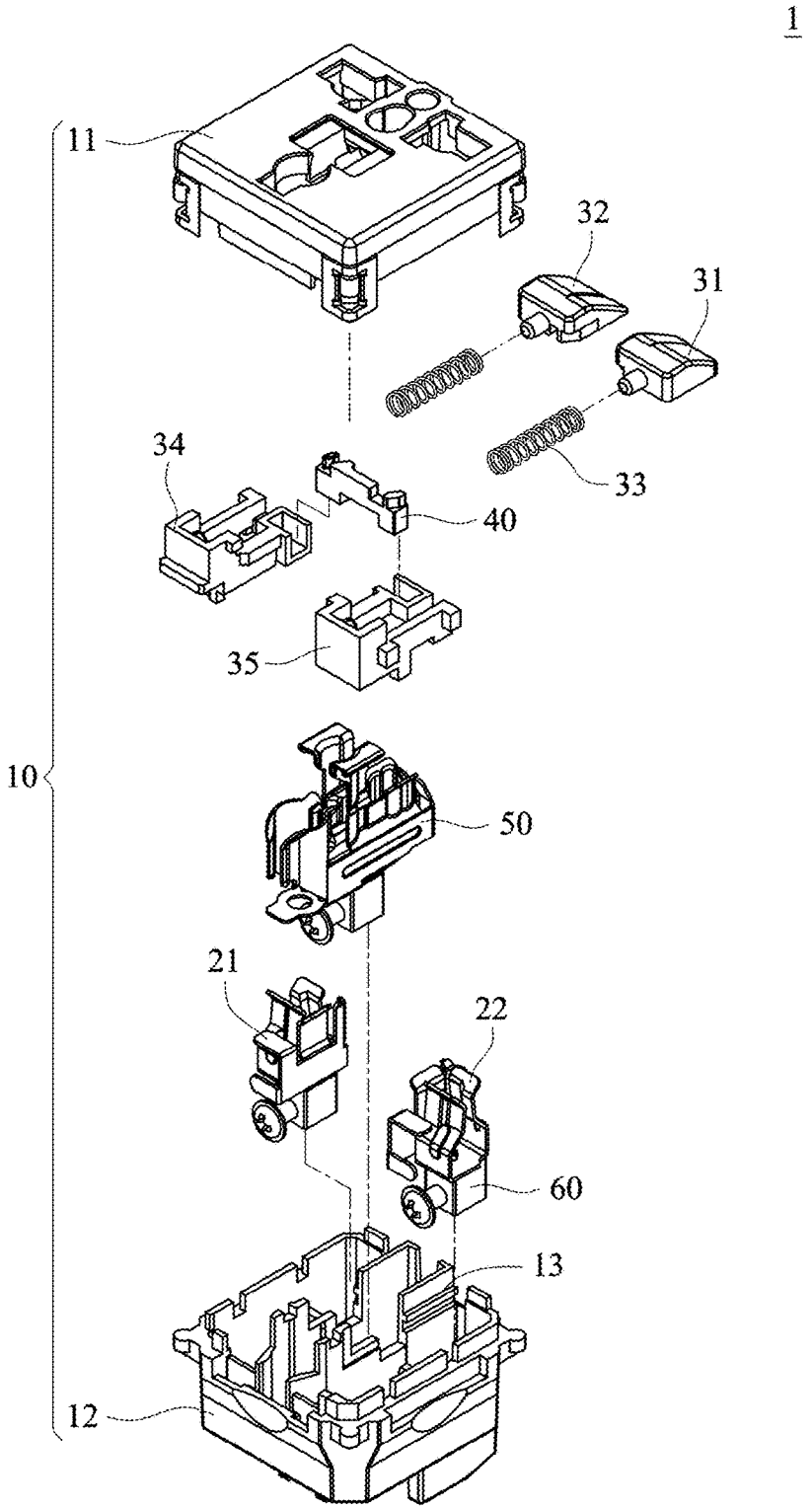
FIG. 1A is an exploded schematic view of a power connector according to an embodiment of the invention.
Figure 1B:
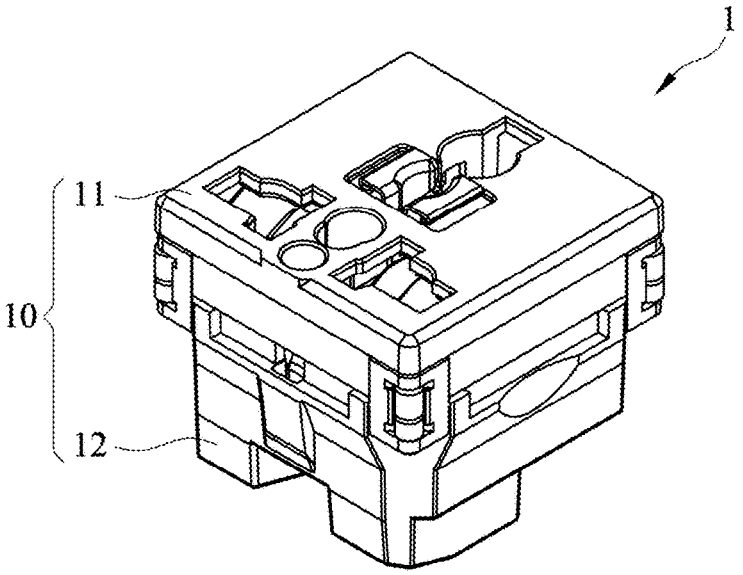
FIG. 1B is a perspective schematic view of a power connector according to an embodiment of the invention.

A power connector 1 according to a preferred embodiment of the invention is shown in FIGS. 1A and 1B, which comprises a dielectric housing 10, two power output frames 21, 22 mounted in the housing 10, a pair of safety shutters 31, 32 mounted in parallel within the housing 10, and an elongated locking bar 40 detachably and slidably engaged with both safety shutters 31, 32.

The dielectric housing 10 comprises a top face panel 11, a bottom face panel 12 and a surrounding side wall to define an interior cavity 13. Desirably, the dielectric housing 10 includes two partition walls arranged in parallel to divide the interior cavity 13 into a middle chamber disposed between the partition walls and two lateral chambers disposed at two opposite sides of the middle chamber. The dielectric housing 10 is made of any dielectric material known in the art, such as plastics and phenolic resins. In a preferred embodiment, the top face panel 11 and the rest of the housing 10 are separately injection molded and then assembled together to form a single module.

Figure 2:
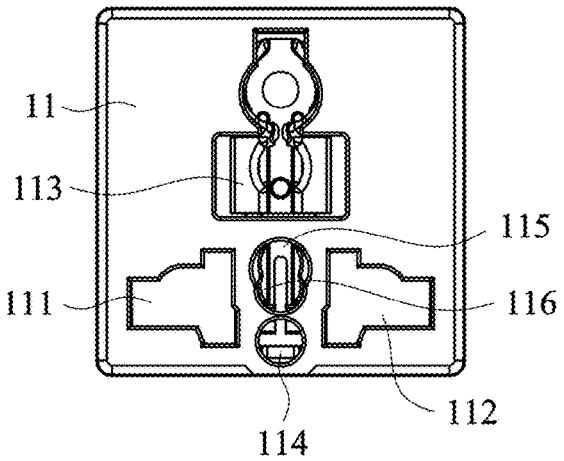
FIG. 2 shows the top face panel of a power connector according to an embodiment of the invention.

The top face panel 11 is formed with a plurality of receptacles to constitute a universal socket layout for receiving the plug types in common use around the world, which include but are not limited to European, British, US, North African and Australian plugs. As shown in FIG. 2, the universal socket layout includes two power receptacles, i.e., the neutral (N) and live (L) receptacles 111, 112, adapted to receive the neutral and live contacts of an electric plug. Preferably, one or more grounding receptacles are formed on the top face panel 11 to receive the grounding contact of the plug, which may include and is not limited to a Schuko grounding receptacle 113, a Swiss grounding receptacle 114 and an Italian grounding receptacle 115 merged with a Brazil grounding receptacle 116. It should be noted that the Swiss grounding receptacle 114 disclosed herein is located at very outside of the universal socket layout, in contrast to its conventional location right next to the Italian grounding receptacle 115. The new location will force a Swiss plug to be inserted into the power connector 1 in a different orientation and thus overcome the N-L reversal problem as in the traditional universal socket layout, a problem having been lasting for the past twenty five years.

Figure 3:
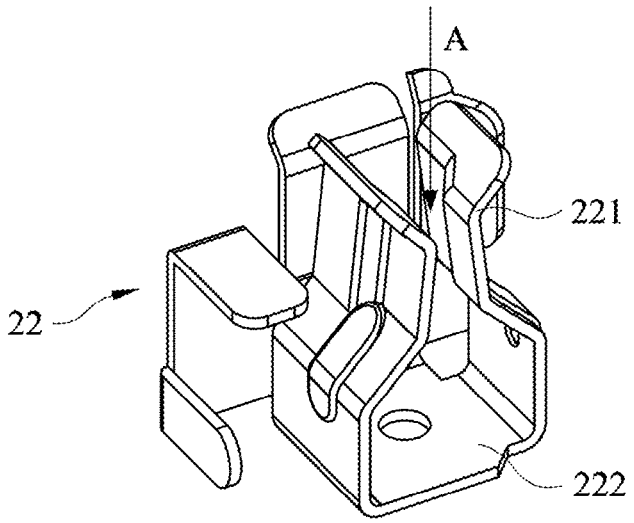
FIG. 3 shows the power output frame of a power connector according to an embodiment of the invention.

The power output frames 21, 22 are secured inside the housing 10 in a manner spaced apart from each other, and preferably held within the lateral chambers of the interior cavity 13, respectively. Each of them is preferably a single-piece element made of material with high electrical conductivity, preferably made of one or more conductive metal elements or metal alloys, such as brass or phosphor copper. The power output frames 21, 22 can be fabricated by any process known in the art, including metal stamping and punch pressing. As shown in FIGS. 1A and 3, the power output frames 21, 22 each includes an output contact portion 211, 221 facing towards the top face panel 11 and an input portion 212, 222 remote from the top face panel 11, preferably facing towards the bottom face panel 12. The output contact portion 211, 221 each includes a resilient member for holding the male power contacts of a plug, which is preferably configured in the form of a resilient metal clip having a gripping part conforming in shape to the shapes of the prong-, blade- and pin-shaped male contacts of the plugs used in various countries. The output contact portion 211, 221 are registered with the power receptacles 111, 112, so that they are adapted for receiving the power contacts of the electric plug through the power receptacles 111, 112 along an insertion direction indicated by the arrow A, thereby establishing electrical connection between the power output frames 21, 22 and the electric plug.

Figure 4A:
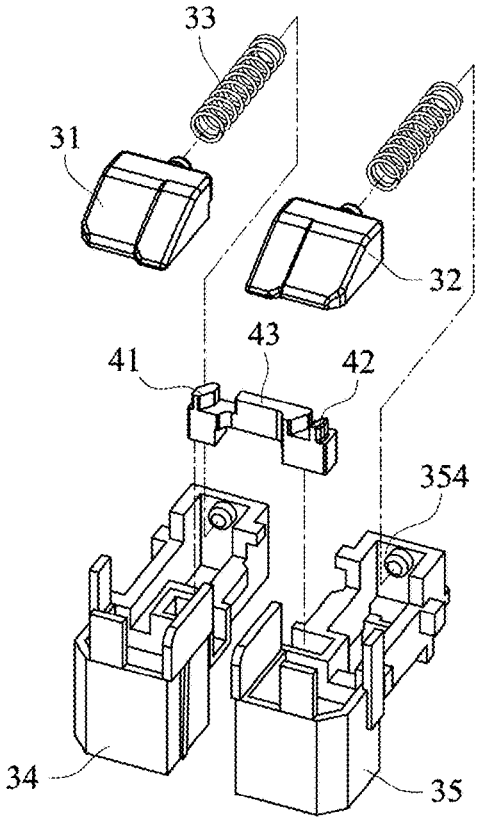
FIGS. 4A-4D are schematic views of the safety shutters according to an embodiment of the invention.
Figure 4B:
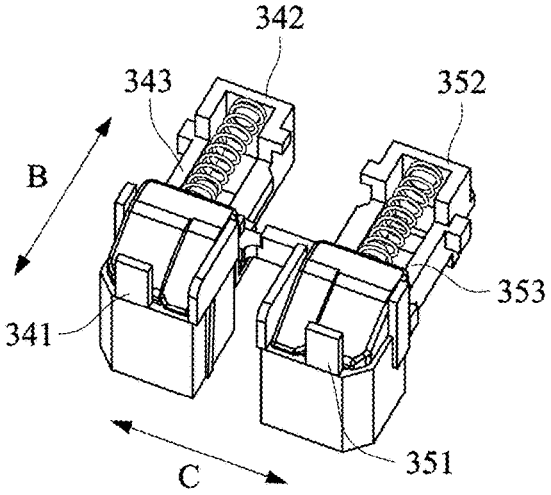

Now referring to FIGS. 4A-4B, the safety shutters 31, 32, preferably made of dielectric material, are mounted within the housing 10 and maintained in generally parallel spaced relationship with each other by the locking bar 40 as described below. This can be realized by defining two confined parallel paths in the housing 10 for the safety shutter 31, 32 to travel back and forth. In the preferred embodiments, the travel paths are defined by a pair of support members 34, 35 alone or together with the housing 10. The support members 34, 35, preferably made of dielectric material, are mounted in the two lateral chambers of the interior cavity 13, each comprising two opposite side walls 341, 342, 351, 352 and a travel path 343, 353 extending between the opposite side walls 341, 342, 351, 352, along which the safety shutters 31, 32 may slide between the two opposite side walls 341, 342, 351, 352 in a travel direction indicated by the arrow B generally perpendicular to the insertion direction A and generally parallel to the top face panel 11.

The safety shutters 31, 32 are each attached at the rear end thereof to a biasing member 33 which is in turn anchored to the rear walls 342, 352. Desirably, the rear ends of the safety shutters 31, 32 and the walls 342, 352 are each provided with a stud 324, 354 for anchorage of the biasing members 33. In the preferred embodiments, the biasing member 33 is a slightly compressed spring extending in the direction B, so that the front ends of safety shutters 31, 32 are normally urged to abut against the front walls 341, 351 and biased to their advancing position as shown in FIG. 4B, thereby closing the power receptacles 111, 112. It is apparent to those skilled in the art that other types of biasing members can also be used in the invention, as long as they are useful in biasing the safety shutters 31, 32 to the advancing position.

Figure 4C:
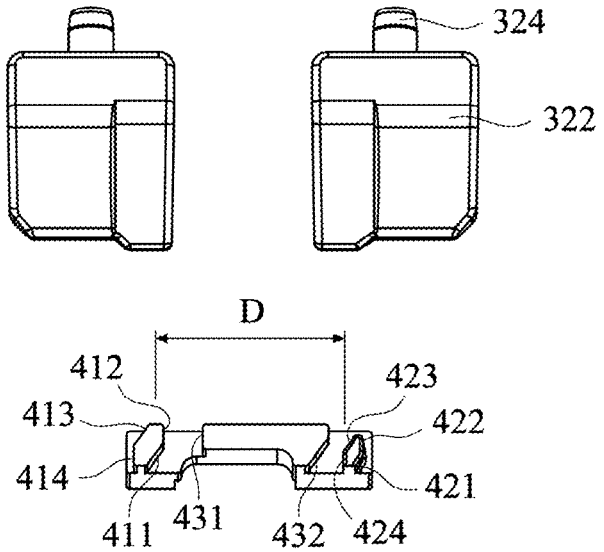
Figure 4D:
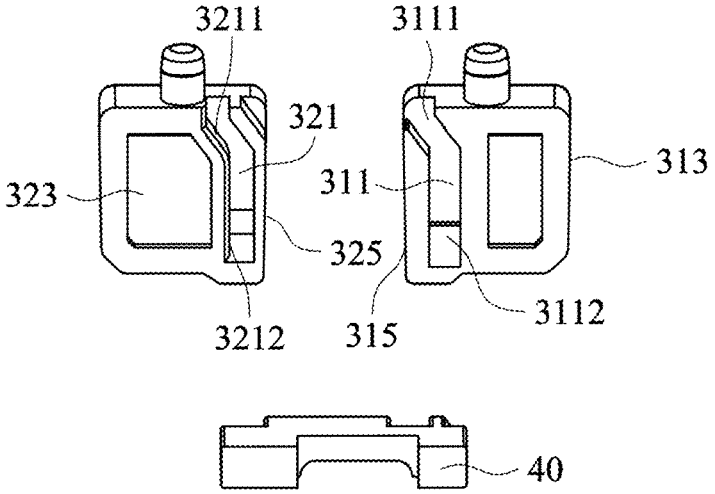
Figure 5A:
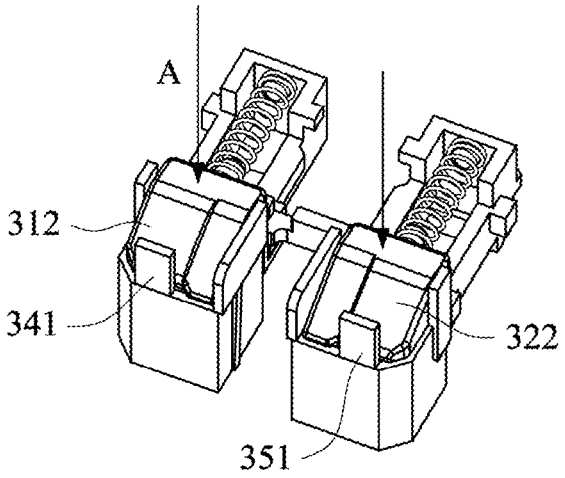
FIGS. 5A-5D are schematic views showing the operation of the safety shutters according to an embodiment of the invention.
Figure 5B:
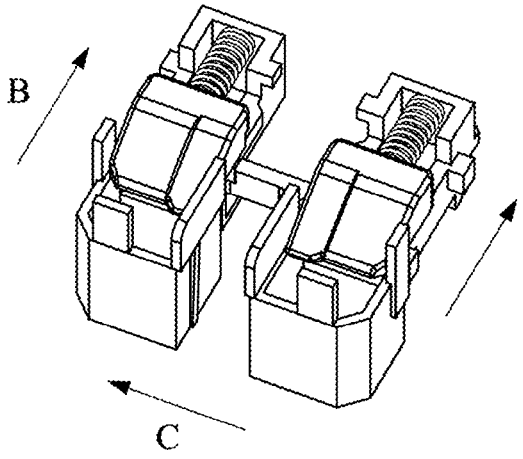
Figure 5C:
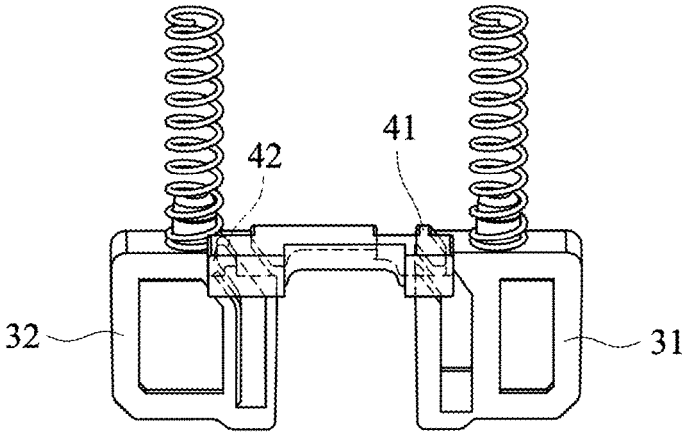
Figure 5D:
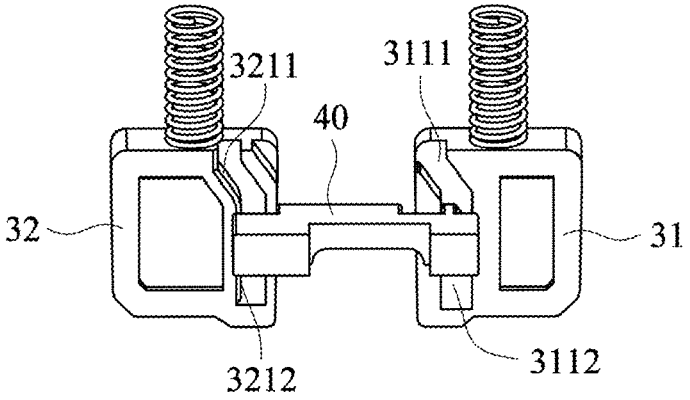

As shown in FIGS. 4C-4D, the safety shutters 31, 32 are each provided with a guide member 311, 321 generally extending along the travel direction B. The guide members 311, 321 each configured to include a bent portion 3111, 3211 extending at a sharp angle, such as about 30-45°, relative to the travel direction B, and a straight portion 3112, 3212 connected to and merged with the bent portion 3111, 3211 and extending along the travel direction B. The respective straight portions 3112, 3212 may be connected to the corresponding bent portions 3111, 3211 with a sharp or rounded inner corner. Since the safety shutters 31, 32 are kept in generally parallel at all times by the locking bar 40, the two guide members 311, 321 are similarly spaced apart in parallel by a fixed distance D at all times. Further, the safety shutters 31, 32 each includes a upper surface 312, 322 proximate to the top face panel 11 and a lower surface 313, 323 opposite to the upper surface 312, 322 and preferably facing away from and generally parallel to the top face panel 11. Preferably, the safety shutters 31, 32 are tapered into a wedge-like form, so that the upper surface 312, 322 are each in the form of a slant surface inclined downwardly towards the lower surface 313, 323.

The locking bar 40, preferably made of dielectric material, is mounted in the housing 10 and extends along a direction traversing, preferably substantially perpendicular to, the travel direction B, as indicated by the arrow C. The locking bar 40 is held by the housing 10, preferably confined in a compartment defined by the housing 10, in a manner sildably movable in the traverse direction C but unmovable in the travel direction B. The locking bar 40 is provided with a first engagement portion 41 and a second engagement portion 42 separate from each other by the same distance D, so as to slidably engage the guide members 311, 321. According to the embodiment disclosed herein, both of the guide members 311, 321 are configured in the form of a guide groove 311, 321 formed on the lower surfaces 313, 323 for receiving the engagement portions 41, 42 configured in the form of tabs 41, 42 extending upwardly from the locking bar 40. Preferably, the guide grooves 311, 321 are each defined by two ribs extending on the lower surface 313, 323 in the travel direction B. The tabs 41, 42 each includes a side face 411, 421 inclined at the same angle as that of the bent portion 3111, 3211 relative to the travel direction B and adapted to abut against the bent portion 3111, 3211 when the safety shutters 31, 32 rest at their advancing position. By virtue of this abutment relationship, if the safety shutters 31, 32 move towards the locking bar 40 along the travel direction B, the inclined side faces 411, 421 would simultaneously receive an equal component force in the traverse direction C and, as a result, the locking bar 40 would be driven to move along the traverse direction C. More preferably, the locking bar 40 is further formed with a protrusion 43 between the tabs 41 and 42. The protrusion 43 includes two end faces 431, 432 facing towards and adapted to slidably abut against side walls 315, 325 of the safety shutters 31, 32 perpendicular to the upper surfaces 312, 322 and the lower surfaces 313, 323.

In some embodiments, the tabs 41, 42 are each configured in the form of a parallelogramoid body having four side faces as shown in FIG. 4C, where the inclined side face 411, 421 and the opposite side face 413, 423 parallel thereto are arranged to incline relative to the travel direction B and abut against the bent portion 3111, 3211 when the safety shutters 31, 32 are at their advancing position. The side faces 412, 422 and the opposite faces 414, 424 are arranged to be generally parallel to the travel direction B and abut the respective straight portions 3112, 3212 during the period that the safety shutters 31, 32 are moving along the travel direction B.

The operation of the power connector 1 disclosed herein will now be described with reference to FIGS. 5A-5D. When a two- or three-pin electric plug is being inserted into the power connector 1, the pressing force of the live and neutral male contacts applied onto the upper slant surfaces 312, 322 along the insertion direction A will generate a component force in the travel direction B to urge the safety shutters 31, 32 away from the walls 341, 351, against the biasing force applied by the biasing members 33. Since the component forces applied onto the respective upper slant surfaces 312, 322 are approximately equal, the respective inclined side faces 411, 421 of the tabs 41, 42 are pushed evenly as a result of their abutment on the bent portions 3111, 3211, thereby driving the locking bar 40 to move in the traverse direction C as the safety shutters 31, 32 move rearwards along the travel direction B. The protrusion 43 assists and stabilizes the whole sliding process by slidably abutting its end faces 431, 432 on the side walls 315, 325 of the safety shutters 31, 32. As the safety shutters 31, 32 are moved to a retracted position shown in FIGS. 5B and SD, the power receptacles 111, 112 are fully opened and the tabs 41, 42 are brought in engagement with the straight portions 3112, 3212. When the male contacts are removed from the power connector 1, the safety shutters 31, 32 move back to the advancing position shown in FIGS. 5A and 5C to close the power receptacles 111, 112, and the locking bar 40 returns as well.

According to the embodiment disclosed herein, the engagement between the tabs 41, 42 and the bent portion 3111, 3211 ensures that the respective tabs 41, 42 will get stuck in the bent portions 3111, 3211 if being driven alone. Therefore, if a user attempts to insert an object either into the neutral receptacle 111 alone, or into the live receptacle 112 alone, the safety shutters 31, 32 will remain staying at the advancing position. In either case, the safety shutters 31, 32 is jammed at the advancing position due to the engagement between the bent portions 3111, 3211 and the tabs 41, 42. For example, in the case where the safety shutter 32 is pushed alone towards the locking bar 40, the tab 42 receives a component force in the traverse direction C. The locking bar 40, however, will be impeded from moving in the traverse direction C due to the abutment of the tab 41 against the inclined face of the bent portion 3111, since the safety shutter 31, without receiving any force in the travel direction B, is held at the advancing position. Thus, the safety shutters 31, 32 are only allowed to travel dependently of each other in the travel direction, and an unwanted or improper insertion of a single male contact of the plug into the power receptacles is prevented accordingly.

Figure 6:
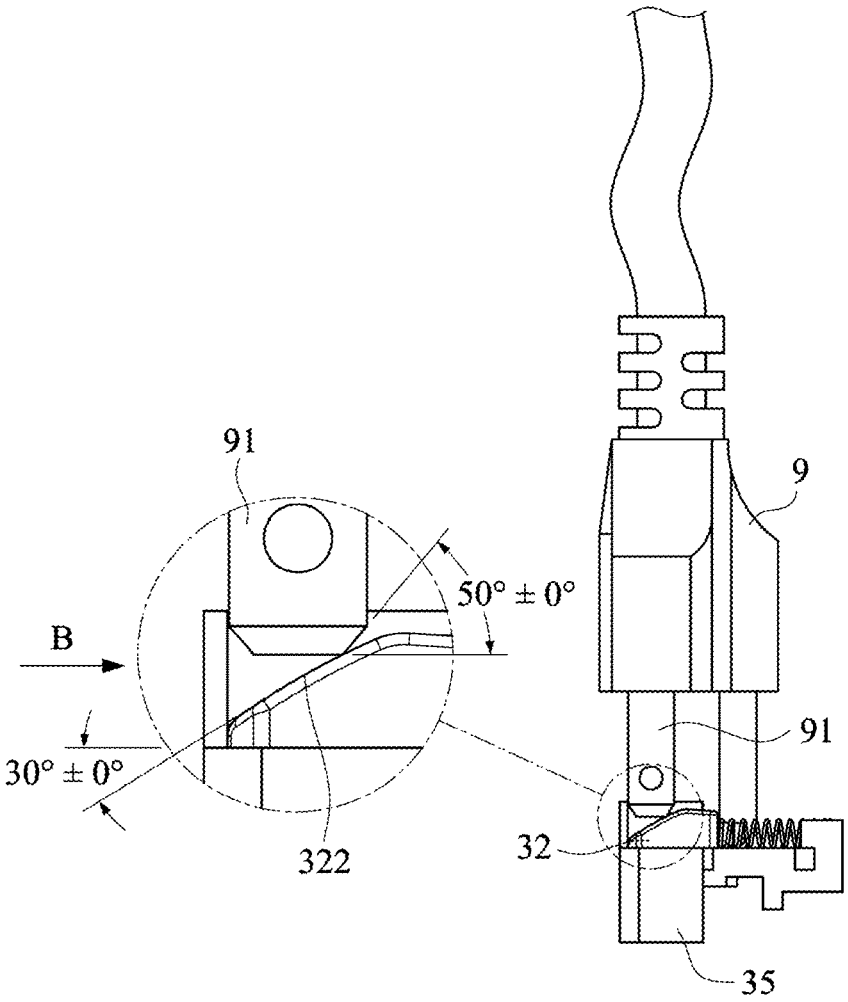
FIG. 6 is a schematic diagram showing that a US polarized plug is brought in contact with the safety shutters.

In the preferred embodiments, the upper slant surfaces 312, 322 are configured to incline at an angle of about 30 degree relative to the travel direction B, as shown in FIG. 6.

Figure 7A:
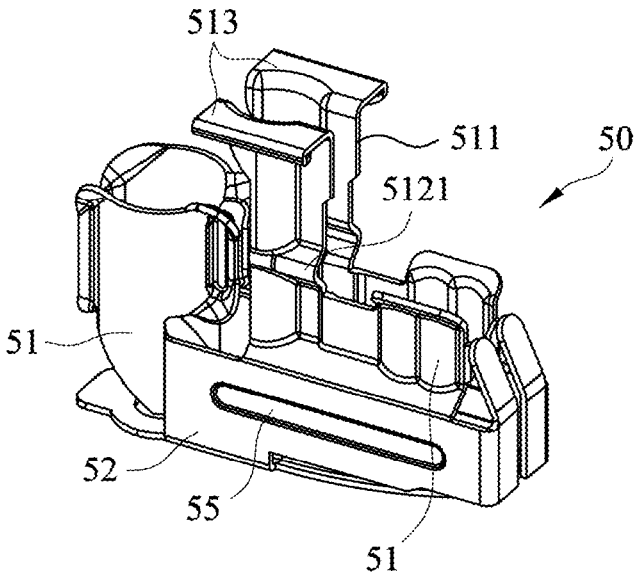
FIGS. 7A-7B are schematic views of the common grounding frame according to an embodiment of the invention.
Figure 7B:
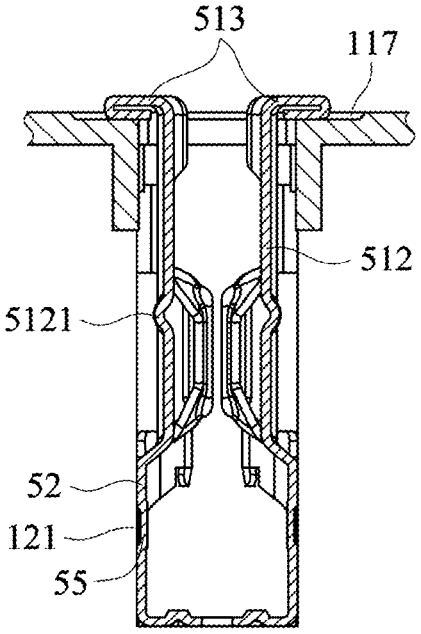

In some preferred embodiments, the power connector 1 disclosed herein further comprises a common grounding frame 50. Desirably, the common grounding frame 50 is secured within the middle chamber of the interior cavity 13. The common grounding frame 50 is preferably a single-piece element made of material with high electrical conductivity, preferably made of one or more conductive metals or metal alloys, such as brass or phosphor copper. The common grounding frame 50 can be fabricated by any process known in the art, such as metal stamping and punch pressing. As shown in FIGS. 1 and 7A, 7B, the common grounding frame 50 includes one or more access portions 51 facing towards the top face panel 11 and a common grounding base 52 remote from the top face panel 11, preferably facing towards the bottom face panel 12. The access portions 51 each includes a resilient member for receiving and holding the grounding contact of a plug, which is preferably configured in the form of a resilient metal clip having a gripping part conforming in shape to the plug contact. The access portions 51 are registered with the grounding receptacles 113-116 formed on the top face panel 11, so that they are adapted for receiving the grounding contact of the electric plug through the grounding receptacles 113-116 along the insertion direction A, thereby establishing electrical connection between the common grounding frame 50 and the electric plug. Among them, a Schuko access portion 511 is adapted to take the male grounding contact of a US, Danish or Israeli plug. The term "Schuko" as used herein refers to a system of AC power plugs and sockets that is defined as CEE 7/3 for the sockets and CEE 7/4 for the plugs by the European Commission for Conformity Testing of Electrical Equipment (CEE). According to the Standards, a Schuko plug features two round pins of 4.8 mm diameter (19 mm long, centers 19 mm apart) for the live and neutral contacts, plus two flat contact areas on the top and bottom side of the plug for protective earth. The gripping part 512 of the Schuko access portion 511 has two free ends extending upwardly and outwardly beyond the top face panel 11 through the Schuko grounding receptacle 113, so as to constitute a flat Schuko contact 513. The Schuko contact 513 is configured in the form of two metal plates lying on shoulder portions 117 surrounding the Schuko grounding receptacle 113 and adapted for engagement with the grounding contact of a CEE 7/4 Schuko plug. The shoulder portions 117 may be cut away a depth for anchorage of the Schuko contact 513. More preferably, the Schuko contact 513 is built in a manner slightly protruding beyond the top face panel 11, such as 1-10 mm higher than the surface of the top face panel 11, so as to ensure good ground contact with the plug.

The Schuko access portion 511 is formed with a curved portion 5121 in the middle of the gripping part 512, thereby gaining sufficient resilience to accept both of the 4.8 mm US ground pin and the 6.0 mm Denmark ground pin and then restore back to its original location and shape required by the Schuko grounding.

In a more preferred embodiment, the safety shutters 31, 32 are so arranged that they are driven to move towards the Schuko contact 513 in response to the insertion of an electric plug. It was unexpectedly found by the inventors that such arrangement facilitates the attachment of the flat ground contact of a Schuko CEE 7/4 plug onto the Schuko contact 513 by urging the safety shutters 31, 32 to push the plug towards the Schuko contact 513. As a result, the shaking problem is reduced to the minimum, and the potential gap between the plug and the power connector is almost non-existent.

Figure 7C:
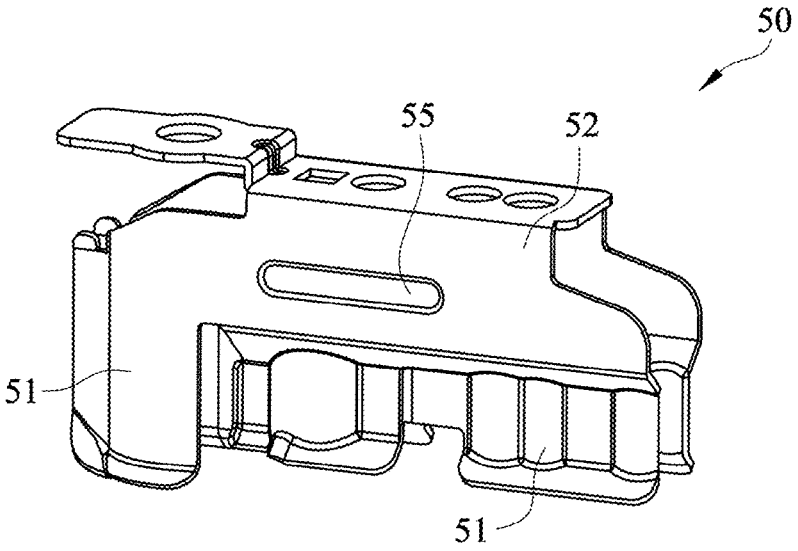
FIG. 7C is a schematic view of the common grounding frame according to an alternative embodiment of the invention.
Figure 7D:
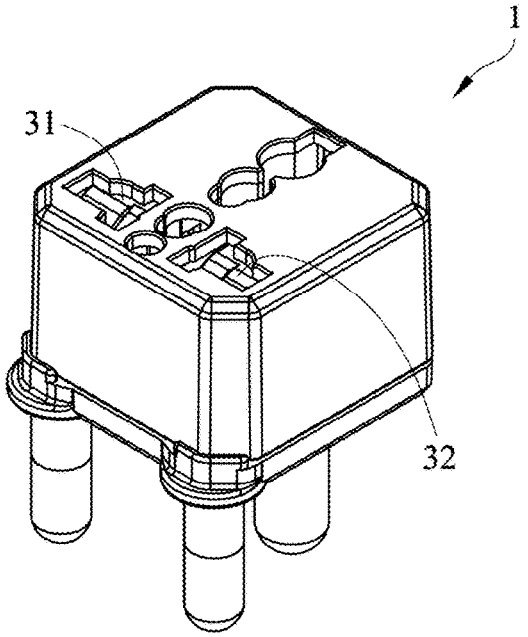
FIGS. 7D and 7E are schematic views of power connectors according to one embodiment of the invention, in which the common grounding frame is free of a Schuko contact.
Figure 7E:
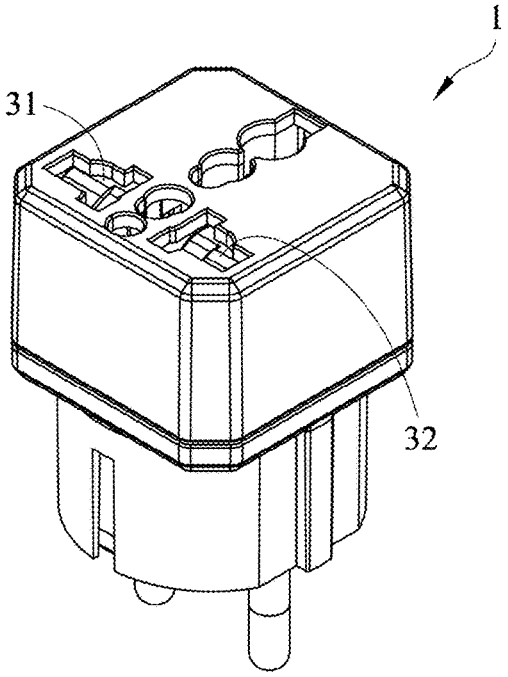

The common grounding frame 50 can be configured to include any combination of access portions 51 to receive plugs of desired specifications. In an alternative embodiment where the power connector 1 is not intended to receive a Schuko plug, the common grounding frame 50 is free of any Schuko contact for engagement with the grounding contact of the Schuko plug. In this case, the common grounding frame 50 does not have a constituting element extending outwardly beyond the top face panel 11, as shown in FIG. 7C. Two power connectors 1, in which the common grounding frame is not provided with a Schuko contact, are shown in FIGS. 7D and 7E.

The input portions 212, 222 and the common grounding base 52 are coupled to a variety of conductive couplers for electrical connection to an external power source, and the power connector disclosed herein can serve as a common architecture applicable to various forms of adapters and socket-outlets accordingly.

In one embodiment, the power connector disclosed herein is fabricated as a universal socket 1' shown in FIGS. 9A and 9B, and the conductive couplers thereof are each configured in the form of a wire holder 60. The wire holder 60 is preferably a hollow metal tube formed at its open end with a blind wire bore 61 for receiving an electrical wire and further formed with a radially extending threaded hole 62 for receipt of a tightening screw 63 to hold down the electrical wire inserted into the wire bore 61. It is well-known by those skilled in the art that there are many other types of wire holders that can be used herein, such as a wire clamp adapted to hold an electrical wire.

Figure 8A:
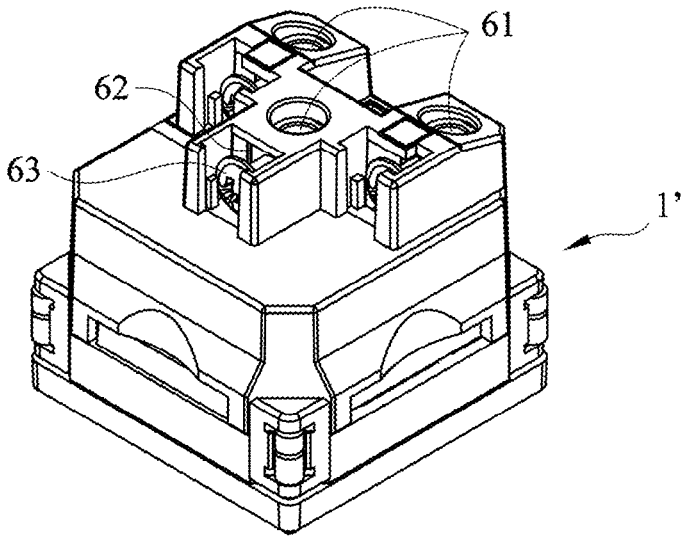
FIG. 8A is a schematic view of the power connector according to one embodiment of the invention, which is in the form of a universal socket.
Figure 8B:
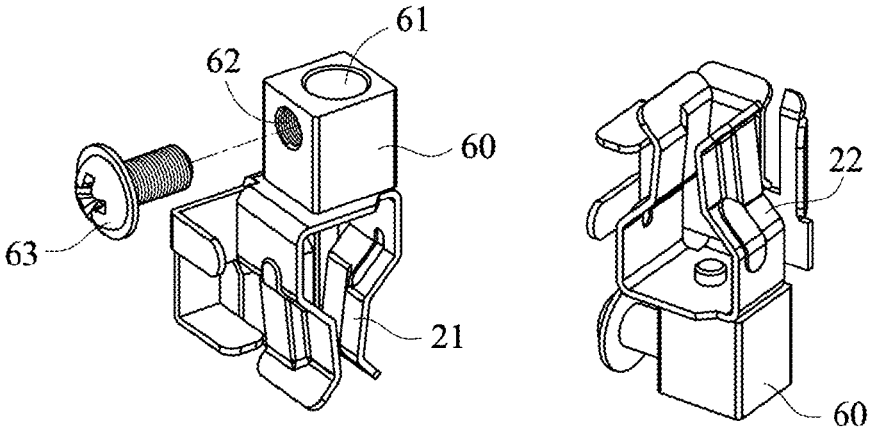
FIG. 8B is a schematic diagram showing the wire holder of the universal socket according to one embodiment of the invention.
Figure 9:
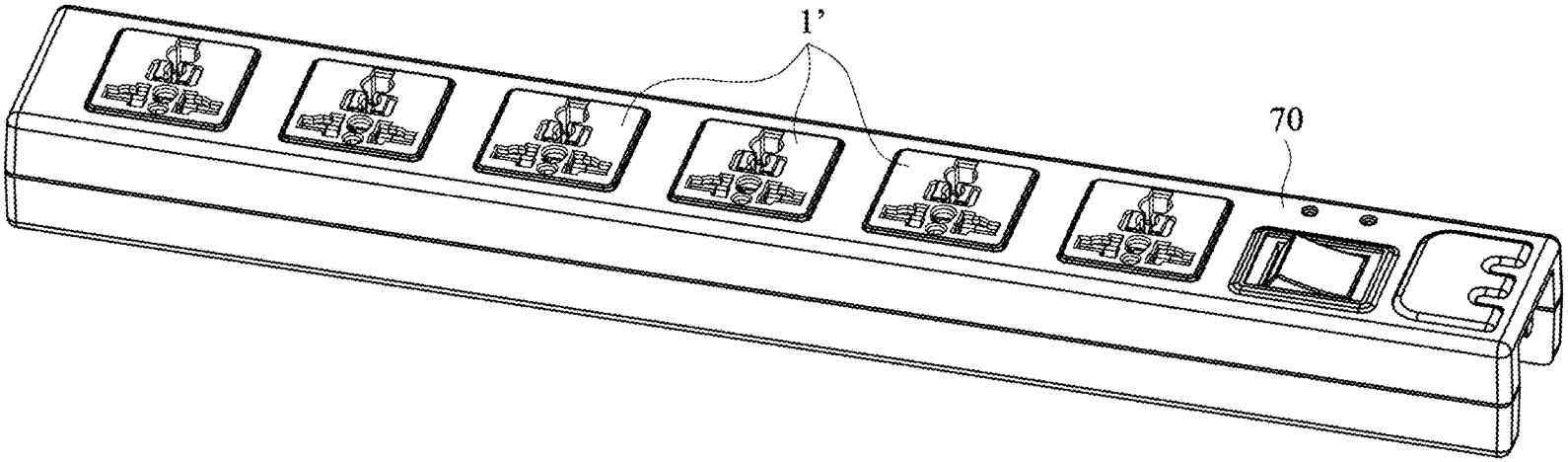
FIG. 9 is a schematic view of the power connector according to an alternative embodiment of the invention, which is in the form of a universal power strip.

In another embodiment, the power connector disclosed herein is fabricated as a universal power strip shown in FIG. 9, in which a number of the universal sockets 1' shown in FIG. 8A are held by a common dielectric chassis 70 and electrically connected in series to a power cord.

Figure 10A:
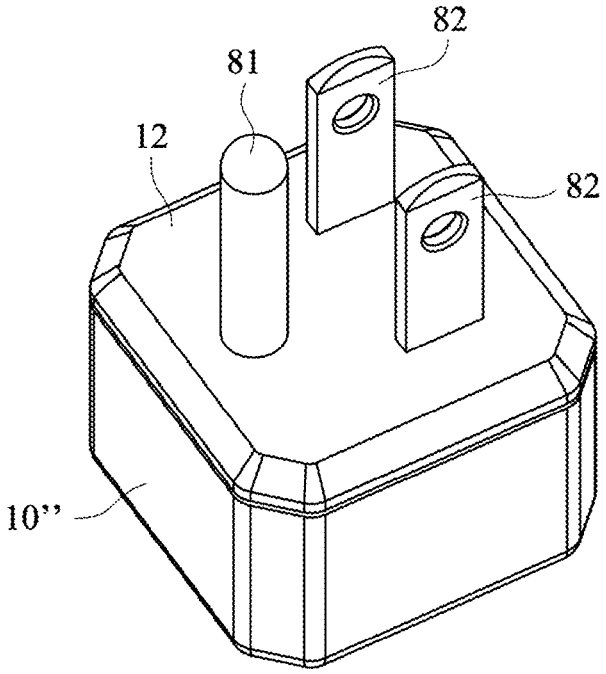
FIG. 10A is a schematic view of the power connector according to another alternative embodiment of the invention, which is in the form of a universal adapter.
Figure 10C:
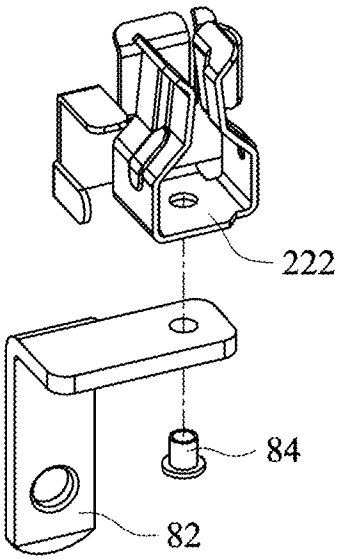
FIG. 10C is a schematic diagram showing the direct wiring connection between the power output frame and the power pin.
Figure 10B:
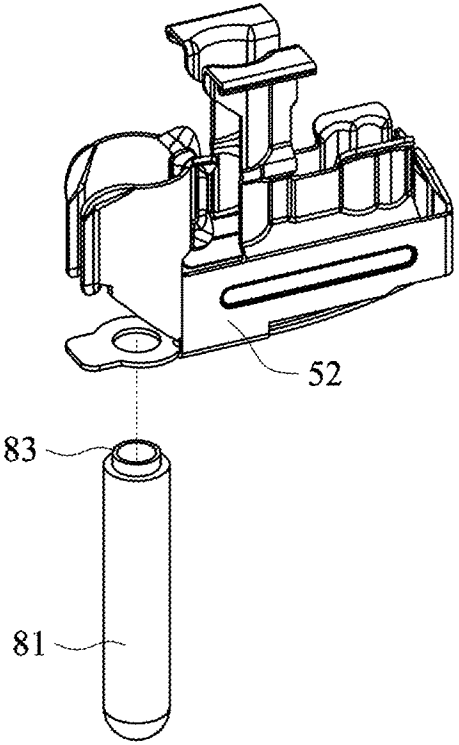
FIG. 10B is a schematic diagram showing the direct wiring connection between the common grounding frame and the ground pin.

In an alternative embodiment, the power connector disclosed herein is fabricated as a universal adapter 1" which comprises a plug part adapted for plugging into a domestic mains socket, in addition to the top face panel 11 at an opposite side adapted for receiving any of a variety of electric plugs. As shown in FIG. 10A, the universal adapter 1" comprises a number of conductive couplers configured in the form of plug contacts 81, 82 conforming to the domestic standards. According to the embodiment disclosed herein, the ground pin 81 is coupled to the common grounding base 52 by a rivet 83 integrally formed on the ground contact 81 as shown in FIG. 10B, whereas the live and neutral pins 82 are similarly fastened to the input portions 212, 222 with a rivet 84 as shown in FIG. 10C.

Figure 11A:
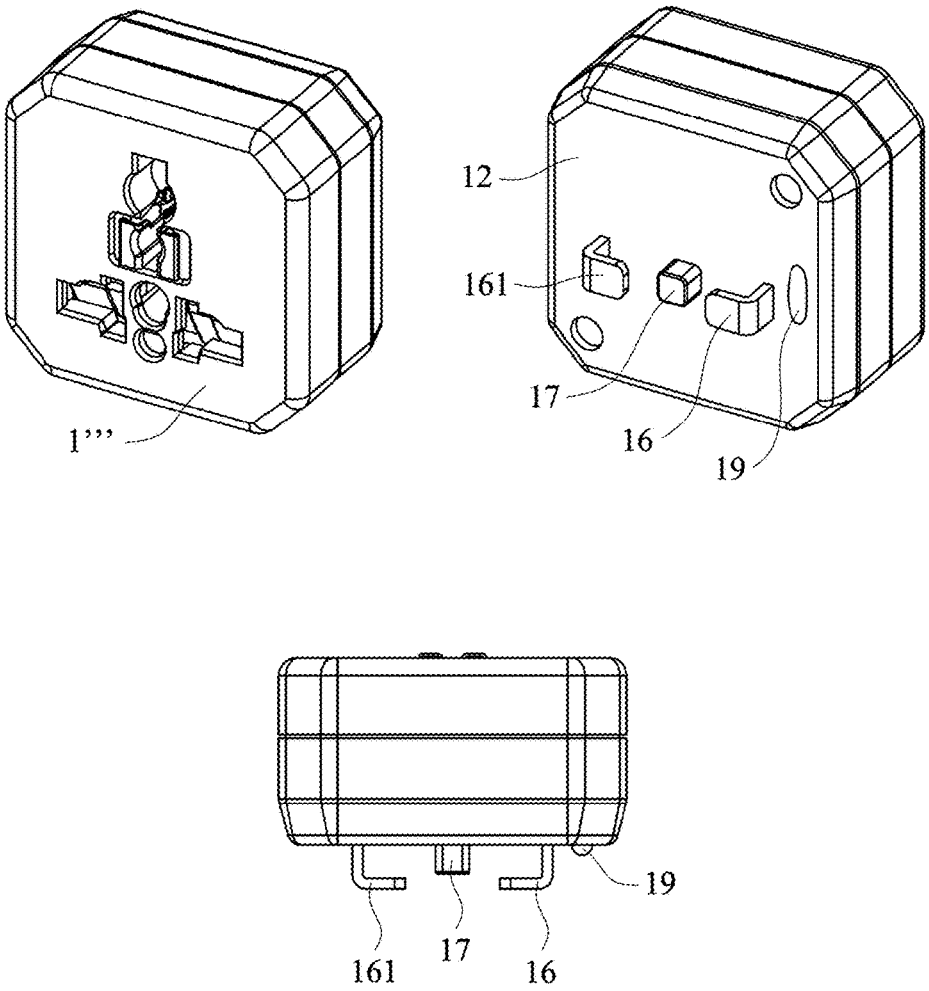
FIGS. 11A-11B are perspective views of the power connector according to another alternative embodiment of the invention, which is in the form of an all-in-one adapter kit.
Figure 11B:
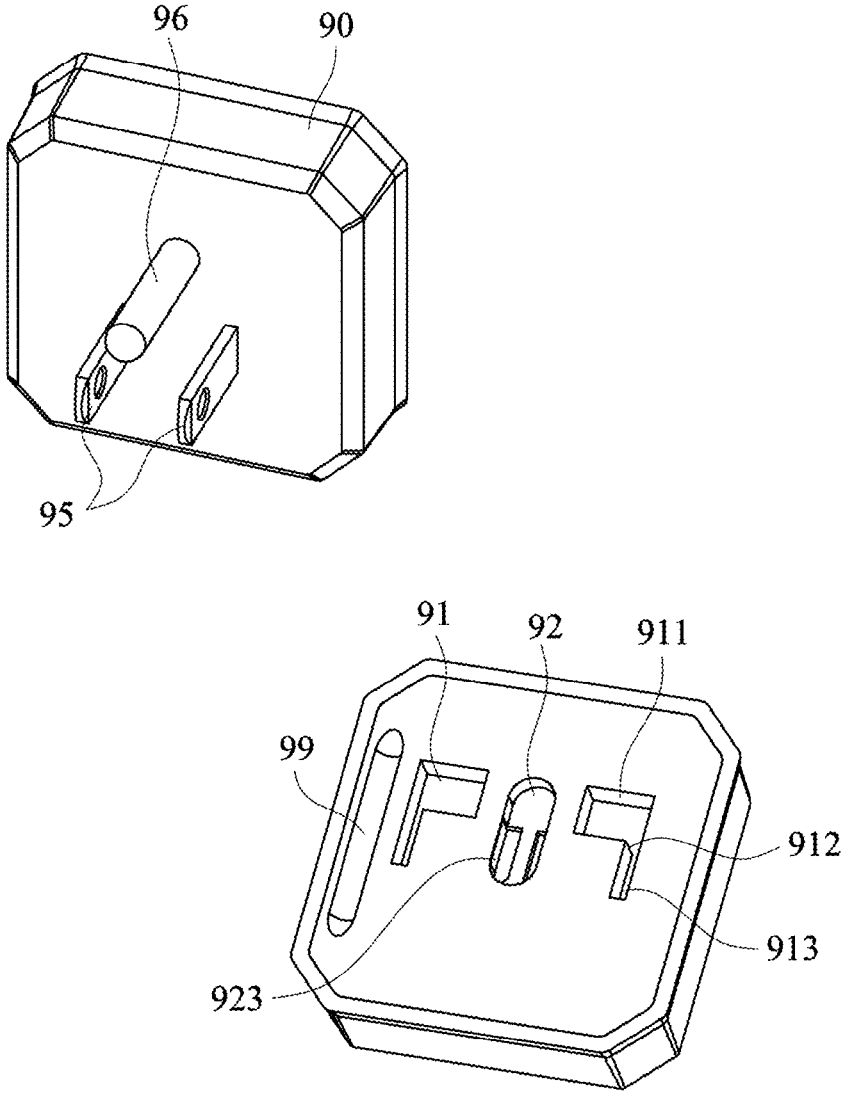

In yet an alternative embodiment, the power connector disclosed herein is fabricated as an all-in-one adapter kit, which comprises a universal socket 1'" shown in FIG. 11A and a set of replaceable plug boards 90 adapted for detachable engagement with and electrical connection to the universal socket 1'". The kit allows the user to interchange a plug board 90 exemplified in FIG. 11B with another plug part provided with a different type of plug pins. It is within the teachings of the present disclosure that the universal socket 1'" may be combined with the replaceable plug boards 90 in any suitable manner to establish the intended electrical connection, such as snap-fit attachment, sliding engagement, and any other suitable releasable connection. In a more preferred embodiment, the universal socket 1'" includes three conductive couplers. Two of them are arranged in direct wiring connection to the input portions 212, 222, respectively, and extend outwardly beyond the bottom face panel 12 to constitute power terminals 16. Desirably, the power terminals 16 are each configured as a vertical blade having an end bent into a horizontal plate 161 parallel to the bottom face panel 12. The remaining one is in direct wiring connection to the common grounding base 52 and extends outwardly beyond the bottom face panel 12 to constitute a ground terminal 17, preferably configured in the form of a metal stud. As exemplified in FIG. 11B, the replaceable plug boards 90 are each formed with two power slots 91 for receiving the power terminals 16 and a ground slot 92 for receiving the ground terminal 17. The power slots 91 are each provided at an end with an expanded opening 911 allowing entry of the horizontal plate 161, and a narrow opening 912 at the opposite end merged with the expanded opening 911, from which the horizontal plate 161 once inserted cannot be pulled out. The power slots 91 and the ground slot 92 are arranged in generally parallel relation to one another, so that the ground terminal 17 gets into the ground slot 92 with the entering of the power terminals 16 into the power slots 91 through the expanded opening 911. Then, the power terminals 16 can be moved to slide along the power slots 91 from the ends 911 to the opposite ends 912 where they engage resilient power contacts 913 connected to the power blades 95 of the plug board 90. As the power terminals 16 are brought in engagement with the resilient power contacts 913, the ground terminal 17 is also brought to abut against a resilient ground contact 923 embedded in the ground slot 92 and connected to the ground pin 96 of the plug board 90.

The engagement mechanism above may also be applied to the universal power strip shown in FIG. 9, as a means to couple the dielectric chassis 70 to the power cord 71 and establish electrical connection between the universal sockets 1' and the power cord 71. According to this embodiment, the input portions 212, 222 of the universal sockets 1' are electrically connected in series to the power terminals, respectively, while the respective common grounding bases 52 are connected in series to the ground terminal.

In a preferable embodiment, the universal socket 1'" is further provided with an error-proof mechanism for ensuring that the replaceable plug board 90 be engaged with the universal socket 1'" only in a correct orientation. The error-proof mechanism may involve any male-female coupling mechanism known in the art, such as the engageable relationship between the flange 19 and the groove 99 shown in FIGS. 11A-11B.

Figure 12:
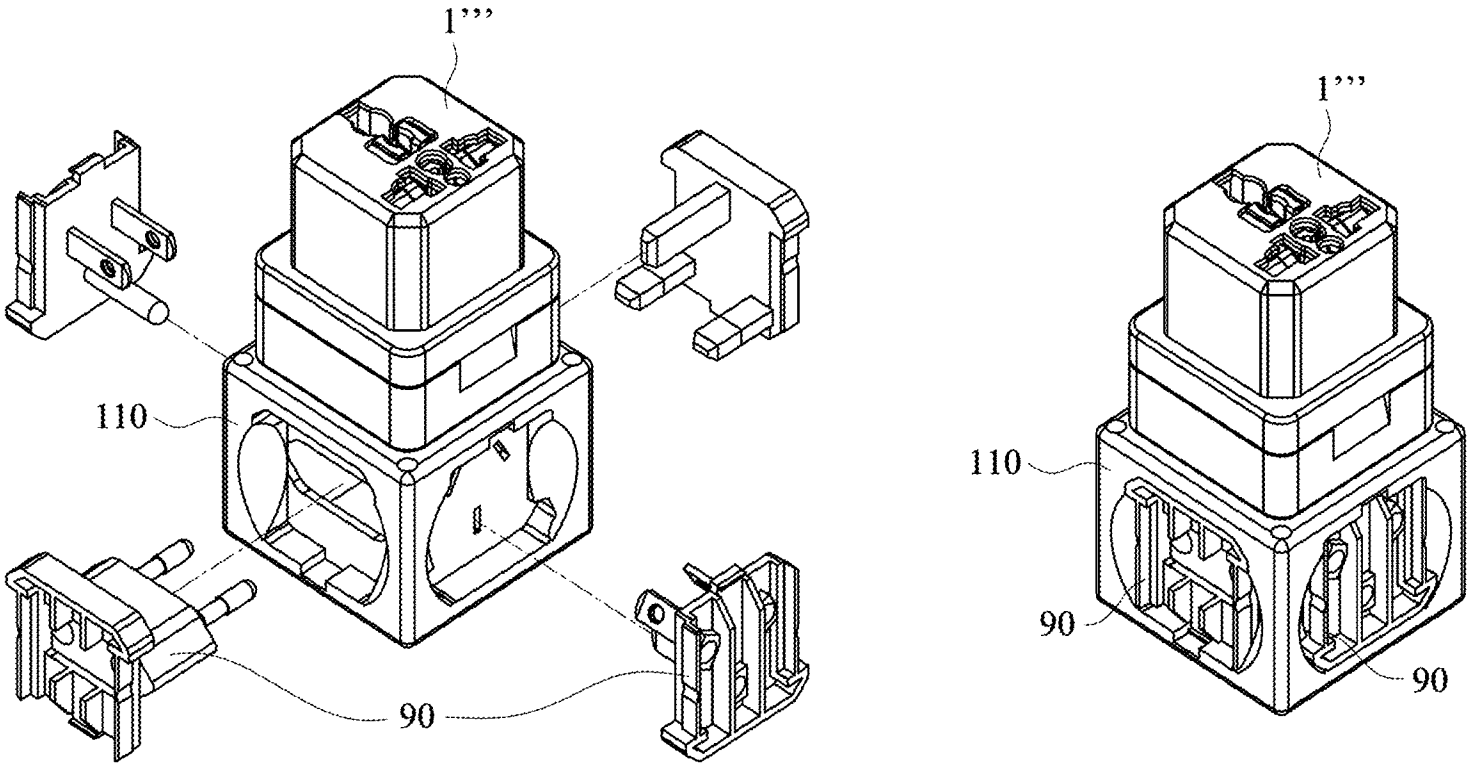
FIG. 12 is a schematic diagram showing that the all-in-one adapter kit are assembled to constitute a pyramid-like packaging.
Figure 13:
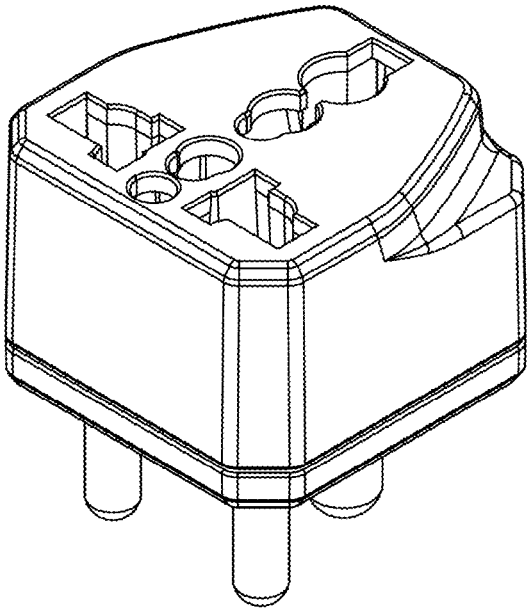
FIG. 13 is a schematic view of a power connector which is not equipped with safety shutters.
Figure 14:
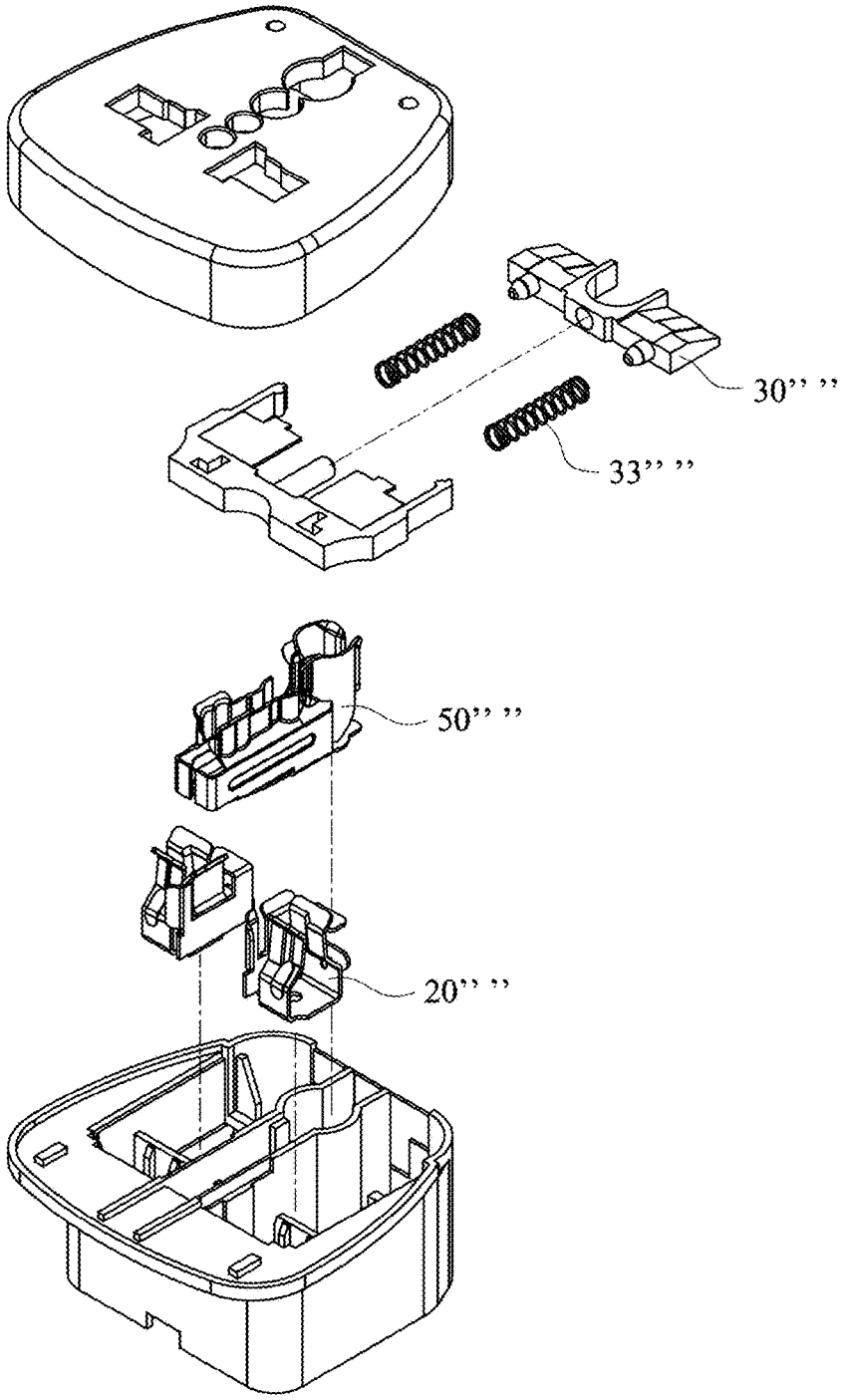
FIG. 14 PRIOR ART
FIG. 14 is an exploded schematic view of a power connector known in the art.

The all-in-one adapter kit may further comprise a polyhedron-shaped snap-in holder 110, to which the universal socket 1'" and the replaceable plug boards 90 are releasably attached to constitute a unitary assembly. In a preferred embodiment, the snap-in holder 111 is cuboid-shaped with five of its facets being configured to be complementary in shape to the universal socket 1'" and the replaceable plug boards 90, respectively, so that the all-in-one adapter kit, after assembled, becomes a pyramid-like packaging with high portability and compactness as shown in FIG. 12.

While the invention has been described with reference to the preferred embodiments above, it should be recognized that the preferred embodiments are given for the purpose of illustration only and are not intended to limit the scope of the present invention and that various modifications and changes, which will be apparent to those skilled in the relevant art, may be made without departing from the spirit and scope of the invention.

What is claimed is:

1. A power connector for engagement with an electric plug having two male power contacts, comprising:

a dielectric housing, comprising a top face panel, wherein the top face panel is formed with two power receptacles through which the male power contacts may be inserted;

two power output frames mounted spaced apart in the housing, each having an output contact portion facing towards the top face panel and adapted for receiving the respective male contact of the electric plug through the respective power receptacle along an insertion direction, and an input portion remote from the top face panel;

a pair of safety shutters mounted in parallel within the housing, wherein the safety shutters are biased in a travel direction generally perpendicular to the insertion direction by respective biasing members to an advancing position to close the power receptacles and each formed with a guide groove; and an elongated locking bar mounted in the housing in a manner extending and movable along a traverse direction traversing the travel direction and unmovable in the travel direction, wherein the locking bar is provided with a first tab and a second tab which are separate from each other by a given distance and slidably engage the respective guide grooves, so that the two guide grooves are spaced apart in parallel by said given distance;

whereby the safety shutters travel dependently of each other along the travel direction to a retracted position to open the power receptacles in response to insertion of the male power contacts;

wherein the safety shutters each includes an upper slant surface arranged proximate to the top face panel and adapted for receiving a pressing force from the respective male power contact;

wherein the locking bar is further formed with a protrusion between the first tab and the second tab, and the protrusion is formed with two end faces facing towards and adapted to slidably abut against respective side walls of the safety shutters perpendicular to the upper slant surfaces;

wherein the guide grooves each comprises a bent portion extending at a sharp angle with respect to the travel direction and a straight portion connected to the bent portion and extending in the travel direction; and wherein the first tab and the second tab each comprises a first side face inclined at the same angle as that of the respective bent portion relative to the travel direction, so that the first tab and the second tab are adapted to abut against the bent portions corresponding thereto with the first side faces when the safety shutters rest at the advancing position.

2. The power connector according to claim 1, wherein the upper slant surfaces are configured to incline at an angle of about 30 degree relative to the travel direction.

3. The power connector according to claim 1, wherein the first tab and the second tab are each configured in the form of a parallelogramoid body having four side faces, with the first side face and a second side face parallel thereto being arranged to incline relative to the travel direction and abut against the respective bent portion when the safety shutters are at the advancing position, and a third side face and a fourth side face opposite thereto being arranged to be generally parallel to the travel direction and abut the respective straight portion during the period that the safety shutters are moving along the travel direction.

4. The power connector according to claim 3, further comprising a pair of support members mounted in the housing, wherein the support members each comprises two opposite side walls and a travel path extending between the opposite side walls in the travel direction, along which the respective safety shutter may slide between the two opposite side walls along the travel direction.

5. The power connector according to claim 4, wherein the biasing member is a spring having an end abutting the respective safety shutter and an opposite end abutting one of the two opposite side walls of the respective support member.

6. The power connector according to claim 5, further comprising a common grounding frame which comprises a resilient metal clip facing towards the top face panel, and wherein the resilient metal clip has two free ends extending upwardly and outwardly beyond the top face panel to constitute a Schuko contact in the form of two metal plates anchored on the top face panel.

7. The power connector according to claim 6, wherein the safety shutters are so arranged that they are driven to move towards the Schuko contact in response to insertion of the electric plug.

8. The power connector according to claim 7, wherein the resilient metal clip is formed with a curved portion in the middle to gain sufficient resilience to expand and subsequently contract.

9. The power connector according to claim 8, wherein the common grounding frame comprises a common grounding base remote from the top face panel, and wherein the input portions and the common grounding base are each directly riveted with a conductive coupler for electrical connection to an external power source.

10. The power connector according to claim 9, wherein the conductive coupler is configured in the form of a wire holder for receiving an electrical wire.

11. The power connector according to claim 9, wherein the conductive coupler is configured in the form of a plug contact for insertion into an electric socket.

* * * * *